US010370153B2

(12) United States Patent
Brignola et al.

(10) Patent No.: US 10,370,153 B2
(45) Date of Patent: Aug. 6, 2019

(54) COLLAPSIBLE STORAGE CONTAINER

(71) Applicants: Emily Yu Wan Brignola, Marietta, GA (US); Emil Brignola, III, Marietta, GA (US)

(72) Inventors: Emily Yu Wan Brignola, Marietta, GA (US); Emil Brignola, III, Marietta, GA (US)

( * ) Notice: Subject to any disclaimer, the term of this patent is extended or adjusted under 35 U.S.C. 154(b) by 0 days.

(21) Appl. No.: 15/843,895

(22) Filed: Dec. 15, 2017

(65) Prior Publication Data

US 2018/0170620 A1 Jun. 21, 2018

Related U.S. Application Data

(60) Provisional application No. 62/435,507, filed on Dec. 16, 2016.

(51) Int. Cl.

| | |
|---|---|
| ***B65D 25/14*** | (2006.01) |
| ***B65D 21/08*** | (2006.01) |
| ***B65D 25/30*** | (2006.01) |
| ***B65D 21/02*** | (2006.01) |
| ***B65D 25/16*** | (2006.01) |

(Continued)

(52) U.S. Cl.

CPC ..... *B65D 25/14* (2013.01); *B65D 5/0227* (2013.01); *B65D 5/46032* (2013.01); *B65D 21/0212* (2013.01); *B65D 21/086* (2013.01); *B65D 25/16* (2013.01); *B65D 25/30* (2013.01)

(58) Field of Classification Search

CPC ..... B65D 5/60; B65D 5/0227; B65D 5/02; B65D 5/46032; B65D 5/46008; B65D 5/46; B65D 77/062; B65D 1/40; B65D 25/16; B65D 25/14; B65D 25/30; B65D 25/28; B65D 25/2802; B65D 37/00; B65D 21/0212; B65D 21/0209; B65D 21/02; B65D 21/086; B65D 21/08; B65F 1/06; B65F 1/065; B65F 1/14

USPC ..... 220/23.9, 495.11, 495.08, 495.06, 756, 220/770, 908.1, 908, 9.4, 9.3, 9.2, 9.1; 16/425, 422, 110.1, 430; 24/565, 557;

(Continued)

(56) References Cited

U.S. PATENT DOCUMENTS 3,266,707 A * 8/1966 Aust ..... B65D 5/10 222/183

3,502,238 A * 3/1970 Kelley ..... B65F 1/06 220/495.08

(Continued)

*Primary Examiner* — Robert J Hicks

(74) *Attorney, Agent, or Firm* — Thomas Horstemeyer, LLP

(57) ABSTRACT

Various examples are provided for collapsible storage containers. In one example, among others, a storage container includes a rectangular bin, a reinforcing liner sheet, and clamping handles. The rectangular bin can include a cavity defined by a bottom and a plurality of sides including opposite sides having handle openings. The reinforcing liner sheet can include side sections separated by a bottom section, where the side sections include handle openings. The bottom section can be configured to align with the bottom of the rectangular bin and the side sections can be configured to align with the opposite sides of the rectangular bin when the reinforcing liner sheet is inserted into the cavity. The clamping handles can be configured to pass through aligned handle openings in one of the opposite sides and one of the side sections, thereby securing the reinforcing liner sheet in the rectangular bin.

15 Claims, 9 Drawing Sheets

(51) Int. Cl.
*B65D 5/02* (2006.01)
*B65D 5/46* (2006.01)

(58) Field of Classification Search
USPC ..... 229/117.35, 117.34, 117.33, 117.27, 229/117.19, 117.09, 117.26, 199
See application file for complete search history.

(56) References Cited

U.S. PATENT DOCUMENTS

| | | | | | |
|---|---|---|---|---|---|
| 3,632,038 | A * | 1/1972 | Souza | B65D 5/10 | 220/23.4 |
| 4,109,571 | A * | 8/1978 | Difley | B30B 9/3003 | 100/229 A |
| 4,723,740 | A * | 2/1988 | Courtemanche | B65B 67/1233 | 248/227.1 |
| 4,828,894 | A * | 5/1989 | Taylor | B65D 5/323 | 206/423 |
| 4,886,164 | A * | 12/1989 | Stein | A61B 50/36 | 206/366 |
| 4,923,087 | A * | 5/1990 | Burrows | B65F 1/06 | 220/495.1 |
| 4,997,149 | A * | 3/1991 | Koch | B65F 1/06 | 220/495.06 |
| 5,735,495 | A * | 4/1998 | Kubota | B65B 67/1227 | 24/543 |
| 2009/0020657 | A1* | 1/2009 | Dayton | B65B 67/1227 | 248/100 |
| 2010/0243650 | A1* | 9/2010 | Manley | B65B 67/1205 | 220/9.4 |
| 2017/0355520 | A1* | 12/2017 | Curran | B65F 1/06 | |

* cited by examiner

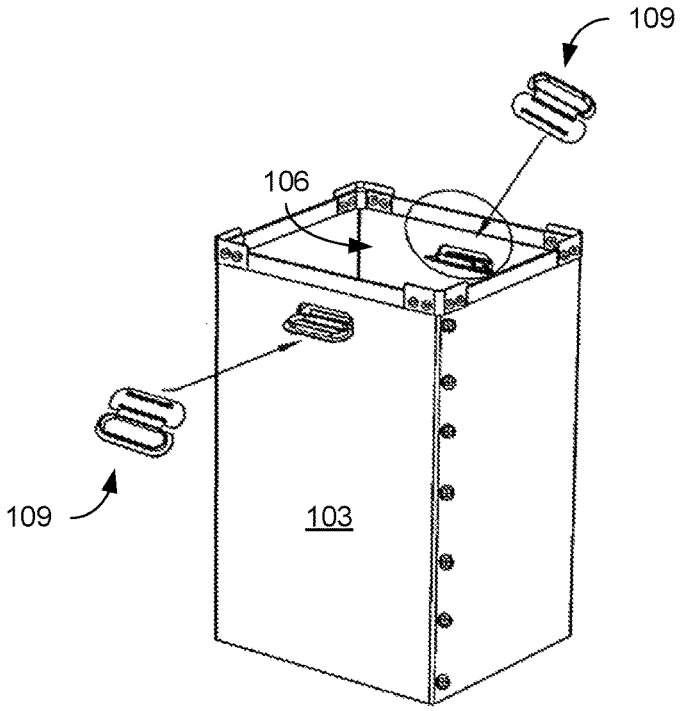
FIG. 8C
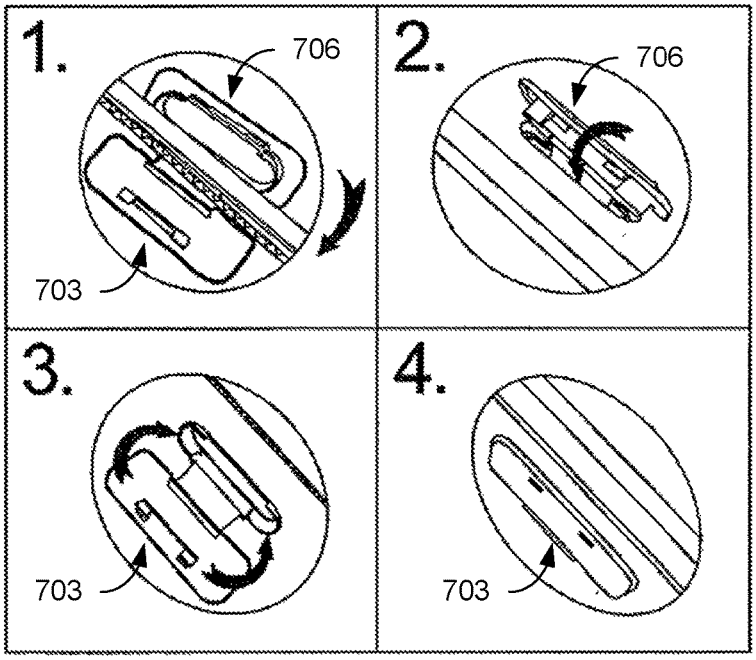

COLLAPSIBLE STORAGE CONTAINER

CROSS REFERENCE TO RELATED APPLICATIONS

This application claims priority to, and the benefit of, U.S. provisional application entitled "Collapsible Storage Container" having Ser. No. 62/435,507, filed Dec. 16, 2016, which is hereby incorporated by reference in its entirety.

BACKGROUND

Storage containers are used in a wide variety of applications. When assembled, storage containers provide a framework around a central void that can be filled by the user. However, the ability to collapse the storage offers space advantages for shipping or storage.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

FIGS. 8A through 8C illustrate an example of the assembly of the storage container of FIG. 1, in accordance with various embodiments of the present disclosure.

DETAILED DESCRIPTION

Figure 1:
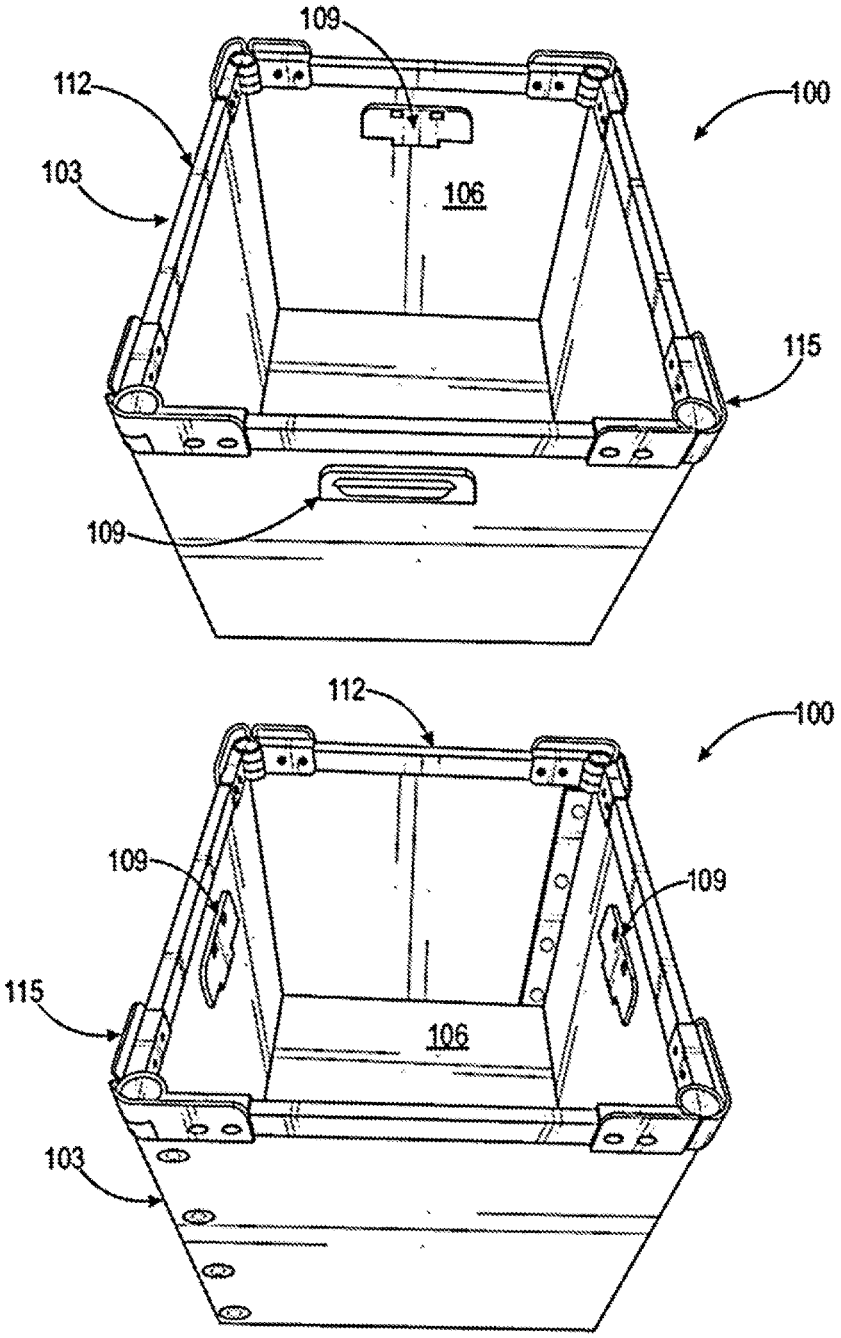
FIG. 1 includes perspective views of an example of a collapsible storage container, in accordance with various embodiments of the present disclosure.

Disclosed herein are various embodiments related to collapsible storage containers. Reference will now be made in detail to the description of the embodiments as illustrated in the drawings, wherein like reference numbers indicate like parts throughout the several views.

Figure 2:
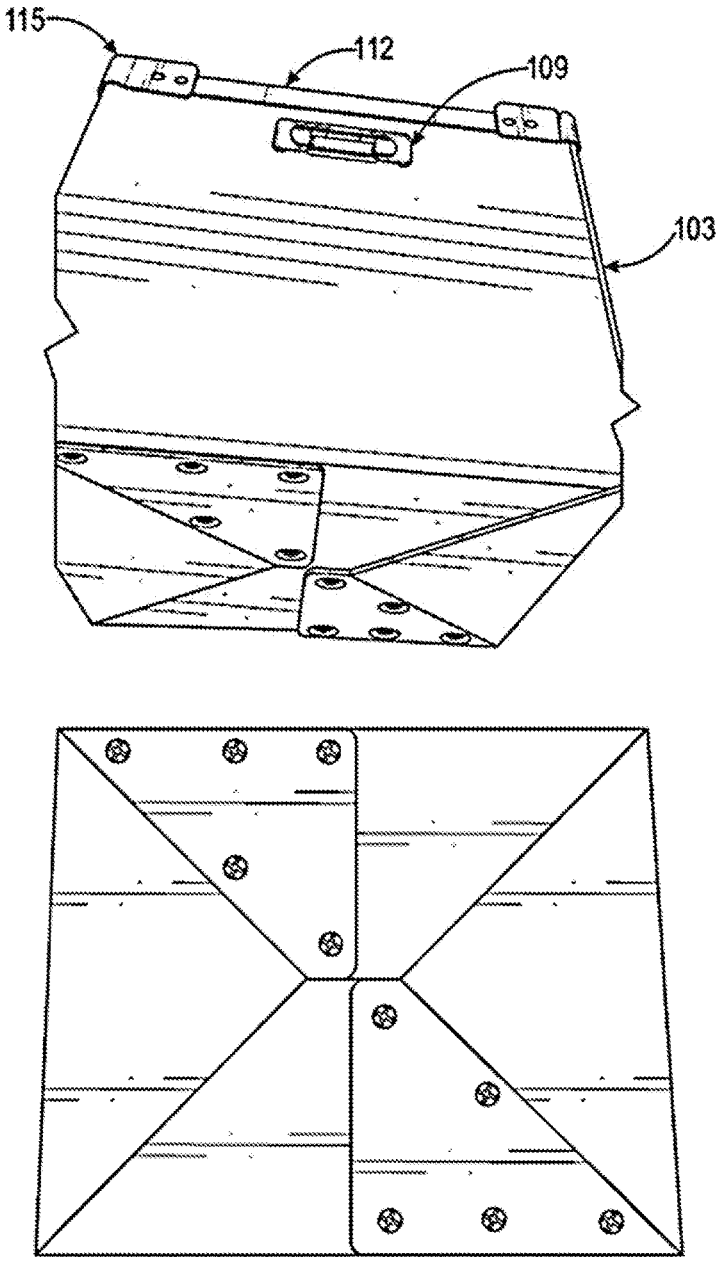
FIG. 2 includes perspective and bottom views of the collapsible storage container of FIG. 1, in accordance with various embodiments of the present disclosure.

Referring to FIG. 1, shown are perspective views of an example of a collapsible storage container 100. The collapsible storage container 100 includes a rectangular bin 103, a reinforcing liner sheet 106, and clamping handles 109 for securing the reinforcing liner sheet 106 in the rectangular bin 103. The rectangular bin 103 includes four sides and bottom panels that overlap when the bin is assembled for use as shown in FIG. 2. The collapsible storage container 100 can be fabricated from an appropriate material such as, e.g., corrugated plastic that can be light-weight while providing the strength and rigidity needed for storage and use. The sides can be secured together at one or more of the corners of the rectangular bin 103. For example, the four sides can be formed from a continuous sheet of material that is secured at opposite ends at one of the corners, or the two sides can be formed from a continuous sheet of material that is secured at both ends to another sheet of material that forms the other two sides of the rectangular bin 103. The sides can include an extension that can overlap with another side to secure the sides together. The sides can be secured together by heated bonding, adhesive, or other suitable methods. Two sides of the rectangular bin 103 include handle openings next to the top edge of the sides to receive the clamping handles 109.

Figure 3:
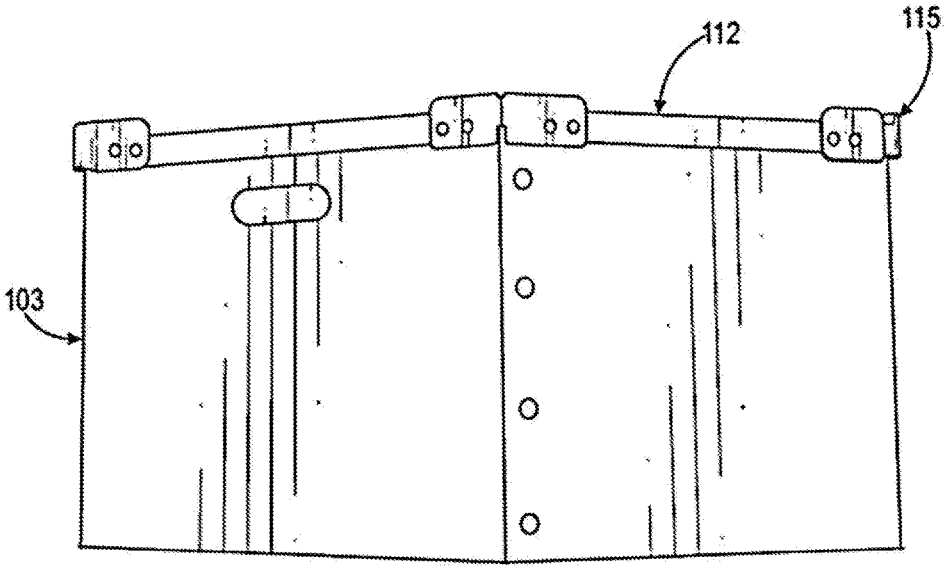
FIG. 3 is an image of the storage container of FIG. 1 after being collapsed and folded flat, in accordance with various embodiments of the present disclosure.

The bottom panels extend from a bottom edge of the sides and can be folded in an overlapping fashion to form the bottom of the rectangular bin 103 as can be seen in FIG. 2. Some or all of the bottom panels can be secured together by heated bonding, adhesive, or other suitable methods. In the example shown in FIG. 2, the bottom panels are secured together to and creased to allow the storage container 100 to be collapsed and folded flat as shown in FIG. 3, which is beneficial for storage and shipment.

The rectangular bin 103 can also include reinforcing members 112 extending across the top edges of the sides. The reinforcing members 112 can be secured together by hinge or foldable elements 115, which allow for pivoted movement of the reinforcing members 112 about the corners of the rectangular bin 103. The combination of reinforcing members 112 and hinge elements 115 can provide rigidity to the rectangular bin 103 and prevent deformation of or damage to the sides of the bin. The reinforcing members 112 and hinge elements 115 can be produced from an appropriate material such as plastic or metal. The reinforcing members 112 and hinge elements 115 can be affixed to the top edge of the sides by fasteners such as, e.g., pins, bolts, screws, etc. As shown in FIG. 1, the hinge elements 115 overlap the reinforcing members 112, which overlap the top edges of the sides. In the example of FIG. 1, pins are to secure the hinge elements 115 and reinforcing members 112 to the bin by passing through the hinge element 115, reinforcing member 112 and sides of the rectangular bin 103 and being secured on the interior side of the hinge element 115. In FIG. 1, the hinge elements 115 include a shoulder ridge to facilitate stacking of storage containers 100.

Figure 4:
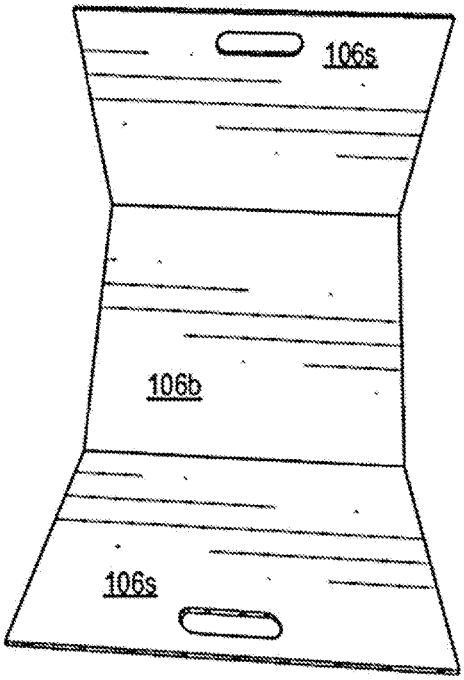
FIG. 4 is an example of a reinforcing liner sheet of the collapsible storage container of FIG. 1, in accordance with various embodiments of the present disclosure.

Referring to FIG. 4, shown is an example of the reinforcing liner sheet 106. The reinforcing liner sheet 106 is formed from a continuous sheet of material that is folded to define two side sections 106*s* and a bottom section 106*b*. The reinforcing liner sheet 106 includes handle openings to receive the clamping handles 109 in the two side sections 106*s* at opposite ends of the reinforcing liner sheet 106. The reinforcing liner sheet 106 is sized to be inserted into the rectangular bin 103 (when assembled) so that the bottom section 106*b* covers the bottom of the bin and the side sections 106*s* extend upward along opposite sides of the rectangular bin 103. The addition of the reinforcing liner sheet 106 to the rectangular bin 103 provides additional strength and support to the bottom of the bin, making the assembly suitable for a wider range of applications.

Figure 5:
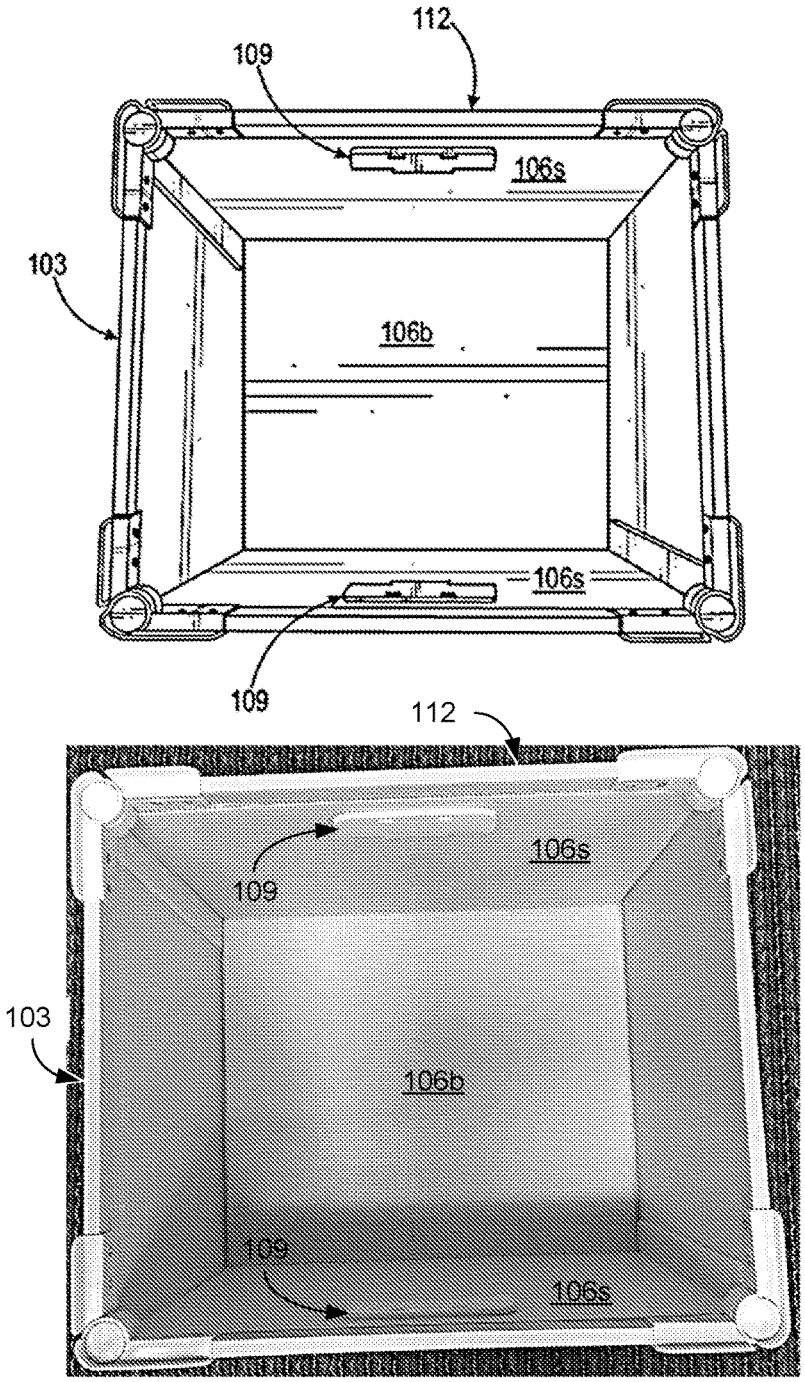
FIG. 5 is a top view of the storage container of FIG. 1, in accordance with various embodiments of the present disclosure.
Figure 6A:
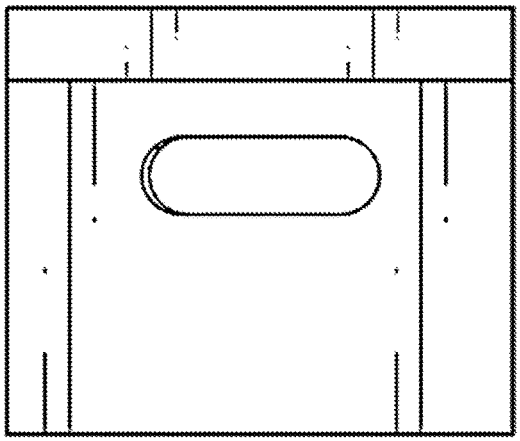
FIGS. 6A through 6C illustrate a handle opening in the rectangular bin and reinforcing liner sheet of the storage container of FIG. 1 after being collapsed and folded flat, in accordance with various embodiments of the present disclosure.
Figure 6B:
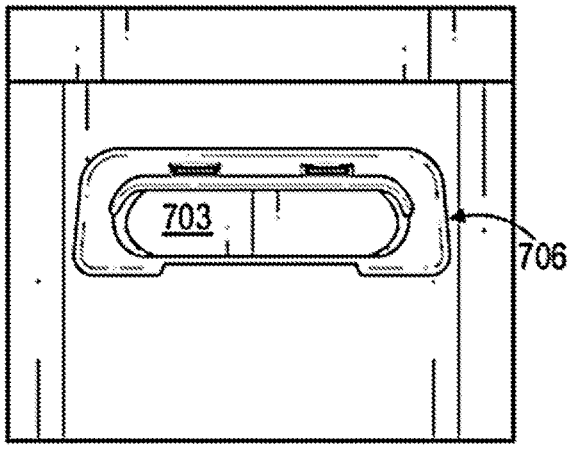
Figure 6C:
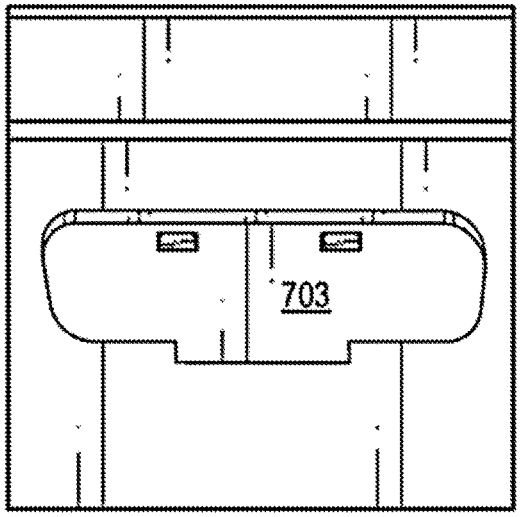
Figure 7A:
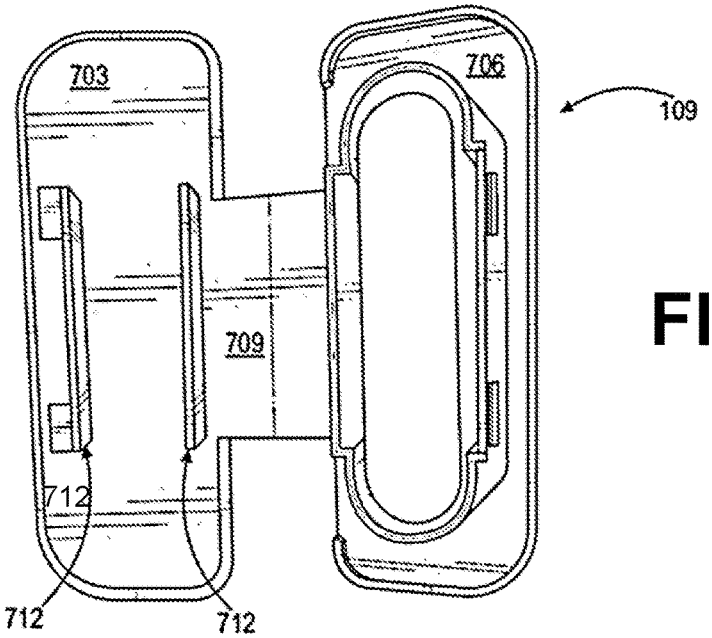
FIGS. 7A through 7D are an example of a clamping handle of the storage container of FIG. 1, in accordance with various embodiments of the present disclosure.
Figure 7B:
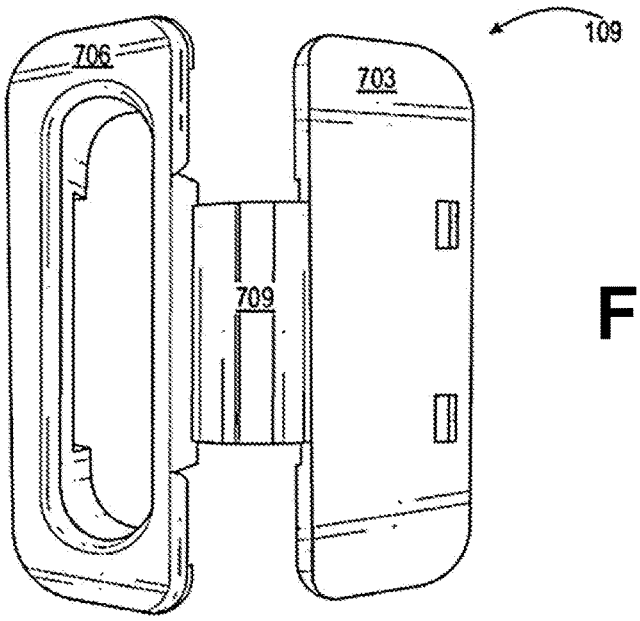
Figure 7C:
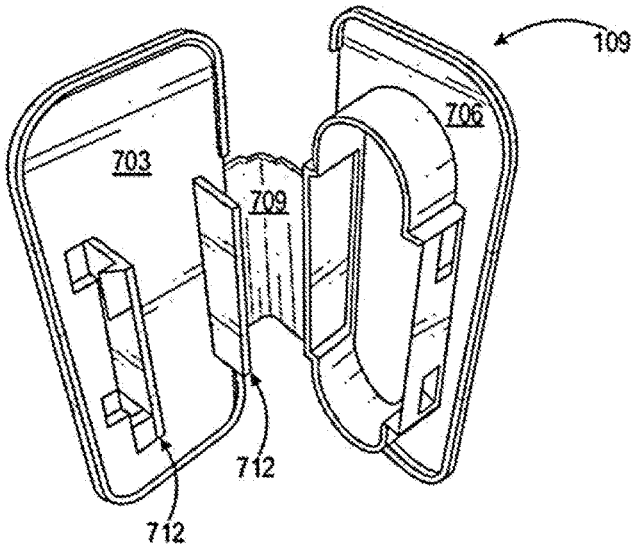
Figure 7D:
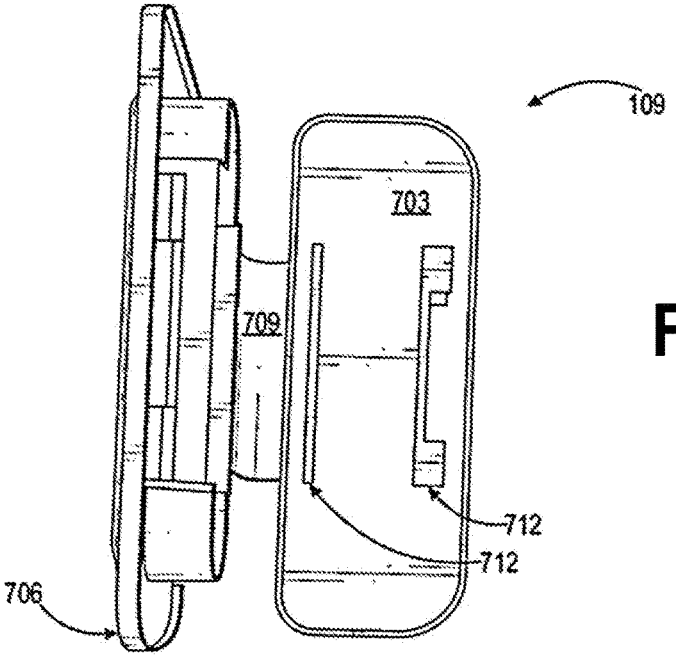

This arrangement can be seen in the top view of FIG. 5 where the reinforcing liner sheet 106 is positioned within the rectangular bin 103. The handle openings of the reinforcing liner sheet 106 align with the handle openings in the opposite sides of the rectangular bin 103. FIG. 6A shows the alignment of the handle openings on one side of the bin 103 and sheet 106. The aligned openings can receive the clamping handles 109 to secure the reinforcing liner sheet 106 in the rectangular bin 103 as shown in FIG. 5. A clamping handle 109 inserted and secured in position as shown in FIGS. 6B (outer side of bin) and 6C (inner side of bin).

FIGS. 7A-7D are images of an example of a clamping handle 109 used to secure the rectangular bin 103 and reinforcing liner sheet 106 together. As can be seen in the images, the clamping handle 109 includes an inner portion 703 and an outer portion 706 that are secured together by a flexible connection 709. In the example of FIGS. 7A-7D, the inner portion 703 includes extensions 712 that fit into the grip opening of the outer portion 706. The grip opening in the outer portion 706 includes a shoulder that is configured to fit inside the handle openings in the sides of the rectangular bin 103 and the reinforcing liner sheet 106. Tabs on one of the extensions can engage with the edge of the grip opening (or a portion of the grip opening) to hold the two portions 703 and 706 together, thus securing the rectangular bin 103 and the reinforcing liner sheet 106 in position.

The clamping handle 109 can be inserted into the aligned handle openings of the rectangular bin 103 and reinforcing liner sheet 106 by first passing the inner portion 703 through the aligned handle openings and then inserting the shoulder of the grip opening in the outer portion 706 into the openings of the rectangular bin 103 and reinforcing liner sheet 106. The outer edge of the outer portion 706 is larger than the handle openings in the rectangular bin 103 and reinforcing liner sheet 106, and thus extends beyond the handle opening edges and presses against the outer surface of the rectangular bin 103. In this arrangement, the flexible connection 709 presses against the inner surface of the reinforcing liner sheet 106. The inner portion 703 can then be rotated at the flexible connection 709 to insert the extension 712 inside the shoulder of the outer portion 706 grip opening to engage the tabs to secure the clamping handle 109 about the rectangular bin 103 and reinforcing liner sheet 106. The outer edge of the inner portion 703 is larger than the handle openings in the rectangular bin 103 and reinforcing liner sheet 106, and thus extends beyond the handle opening edges and presses against the inner surface of the reinforcing liner sheet 106. In this way, the shoulder of the grip opening, and the outer edges of the inner and outer portions maintain alignment between the rectangular bin 103 and reinforcing liner sheet 106. The inner portion 703 also seals off the back side of the grip opening in the outer portion 706 as shown in FIG. 6B. A lip or ridge can extend outward from the upper edge of the grip opening in the outer portion 706 to provide additional area for gripping and lifting of the storage container 100.

Figure 8A:
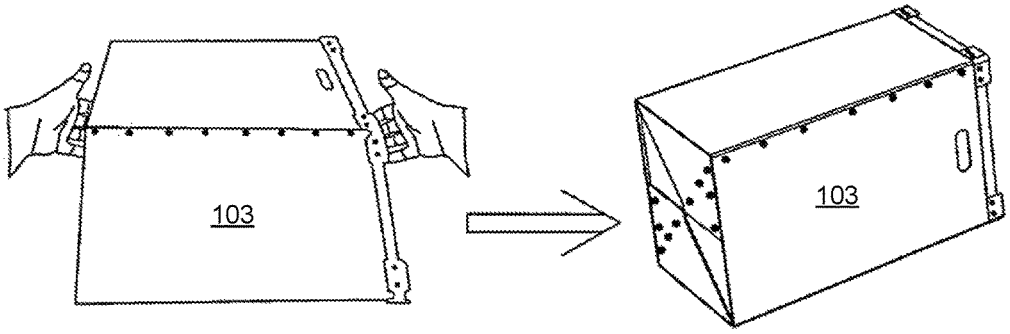
Figure 8B:
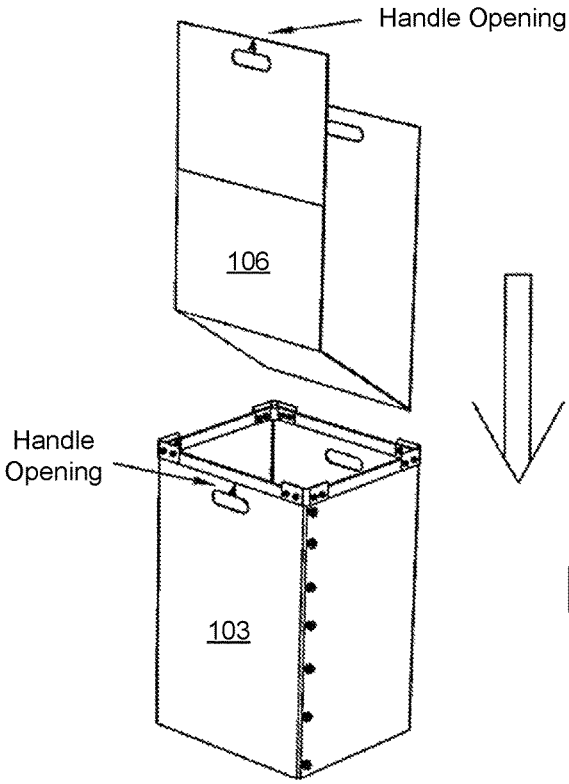

Assembly of the storage container 100 will now be described. To begin, rectangular bin 103 of the collapsible storage container 100 is spread out as shown in FIG. 8A. The rectangular bin 103 can then be placed upright and the reinforcing liner sheet 106 inserted into it with the handle openings aligned as shown in FIG. 8B. With the handle openings aligned, the clamping handles 109 can be installed as illustrated in FIG. 8C. The clamping handles 109 can installed by: (1) sliding a portion of the clamping handle 109 through the handle openings so that the inner portion 703 is inside the rectangular bin 103 and the outer portion 706 with the grip opening is on the outside of the rectangular bin 103; (2) pushing the outer portion 706 into the handle opens so that the shoulder of the grip opening extends through and captures the side of the rectangular bin 103 and the reinforcing liner sheet 106; (3) clipping the inner and outer portions 703 and 706 together by holding the outer portion 703 in place while folding the inner portion 706 about the flexible connection 709; and (4) snapping the inner portion 706 and outer portion 703 in place for use. When both clamping handles 109 are secured, the storage container 100 is ready for service.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include traditional rounding according to significant figures of numerical values. In addition, the phrase "about 'x' to 'y'" includes "about 'x' to about 'y'".

Therefore, at least the following is claimed:

1. A storage container, comprising:

a collapsible rectangular bin comprising a cavity defined by a bottom and a plurality of sides including opposite sides having handle openings extending through the opposite sides of the collapsible rectangular bin;

a removable reinforcing liner sheet comprising side sections separated by a bottom section, the side sections comprising handle openings extending through the side sections of the removable reinforcing liner sheet, where the bottom section is configured to align with the bottom of the collapsible rectangular bin and the side sections are configured to align with the opposite sides of the collapsible rectangular bin when the removable reinforcing liner sheet is inserted into the cavity of the collapsible rectangular bin with the handle openings of the removable reinforcing liner sheet and the collapsible rectangular bin aligned; and first and second clamping handles configured to pass through the aligned handle openings in one of the opposite sides of the collapsible rectangular bin and one of the side sections of the removable reinforcing liner sheet, and secure the removable reinforcing liner sheet in the collapsible rectangular bin.

2. The storage container of claim 1, wherein each of the first and second clamping handles comprise an inner portion and an outer portion coupled together through a flexible connection configured to allow the inner and outer portions to be folded together, wherein the inner portion engages with the outer portion to secure the inner and outer portions in a folded position.

3. The storage container of claim 2, wherein the outer portion includes a grip opening defined by a shoulder.

4. The storage container of claim 3, wherein the shoulder of the grip opening passes through and aligns with the aligned handle openings.

5. The storage container of claim 4, wherein the inner portion includes tabs that engage with a portion of the shoulder to secure the clamping handle on the opposite side of the collapsible rectangular bin and the side section of the removable reinforcing liner sheet.

6. The storage container of claim 1, wherein the collapsible rectangular bin and the reinforcing inner liner are formed from corrugated plastic.

7. The storage container of claim 1, wherein the collapsible rectangular bin comprises reinforcing members extending across top edges of the plurality of sides.

8. The storage container of claim 7, wherein the reinforcing members are secured together by hinged elements that allow pivoted movement of the reinforcing members.

9. The storage container of claim 1, wherein the bottom of the collapsible rectangular bin comprises bottom panels configured to allow the collapsible rectangular bin to collapse and fold flat.

10. The storage container of claim 9, wherein the removable reinforcing liner sheet reinforces the bottom of the collapsible rectangular bin when installed.

11. The storage container of claim 2, wherein the first and second clamping handles secure one of the side portions of the removable reinforcing liner sheet and one of the opposite sides of the collapsible rectangular bin between the inner and outer portions.

12. The storage container of claim 7, wherein the reinforcing members are separate from and overlap the top edges.

13. The storage container of claim 12, wherein the reinforcing members are secured to the top edges by fasteners.

14. The storage container of claim 8, wherein the hinged elements are secured to the top edges by fasteners.

15. The storage container of claim 8, wherein the hinged elements comprise a shoulder ridge opposite the top edges.

* * * * *